US009879574B2

(12) United States Patent
Iguchi et al.

(10) Patent No.: US 9,879,574 B2
(45) Date of Patent: Jan. 30, 2018

(54) VALVE OPENING AND CLOSING TIMING CONTROL APPARATUS

(71) Applicant: AISIN SEIKI KABUSHIKI KAISHA, Kariya-shi, Aichi (JP)

(72) Inventors: Yoshiaki Iguchi, Toyohashi (JP); Yuji Noguchi, Obu (JP); Takeo Asahi, Kariya (JP); Kenji Ikeda, Gotenba (JP); Hiroyuki Hamasaki, Obu (JP); Tomohiro Kajita, Anjo (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 0 days.

(21) Appl. No.: 15/116,838

(22) PCT Filed: Feb. 14, 2014

(86) PCT No.: PCT/JP2014/053482
§ 371 (c)(1),
(2) Date: Aug. 5, 2016

(87) PCT Pub. No.: WO2015/121975
PCT Pub. Date: Aug. 20, 2015

(65) Prior Publication Data

US 2017/0167314 A1 Jun. 15, 2017

(51) Int. Cl.
*F01L 1/34* (2006.01)
*F01L 1/344* (2006.01)

(52) U.S. Cl.
CPC ... *F01L 1/3442* (2013.01); *F01L 2001/34469* (2013.01); *F01L 2001/34483* (2013.01);
(Continued)

(58) Field of Classification Search
CPC ..... F01L 1/3442; F01L 2001/34469; F01L 2001/34483; F01L 2101/00; F01L 2250/06; F01L 2810/02
(Continued)

(56) References Cited

U.S. PATENT DOCUMENTS 6,981,477 B2 * 1/2006 Uozaki ..... F01L 1/3442 123/90.15
2005/0183682 A1 8/2005 Uozaki et al.
2013/0167787 A1 7/2013 Noguchi et al.

FOREIGN PATENT DOCUMENTS

JP 2005-240651 A 9/2005
JP 2012-092739 A 5/2012

OTHER PUBLICATIONS

International Search Report (PCT/ISA/210) dated Mar. 18, 2014, by the Japanese Patent Office as the International Searching Authority for International Application No. PCT/JP2014/053482.
(Continued)

*Primary Examiner* — Zelalem Eshete
(74) *Attorney, Agent, or Firm* — Buchanan Ingersoll & Rooney PC

(57) ABSTRACT

A valve opening and closing timing control apparatus includes a torsion coil spring provided at an accommodation chamber which is defined by a front member provided at a drive-side rotational member and a tubular void provided at a driven-side rotational member, the torsion coil spring engaging with the front member and the driven-side rotational member to bias the driven-side rotational member in an advanced or a retarded angle direction relative to the driven-side rotational member and an oil reservoir portion defined by an outer surface of the torsion coil spring facing the driven-side rotational member and at least one recess portion provided at the driven-side rotational member, the recess portion being provided in a radially outer direction
(Continued)

from a position at a radially outer side than an inner diameter of the torsion coil spring and at a radially inner side than an outer diameter of the torsion coil spring.

5 Claims, 5 Drawing Sheets

(52) U.S. Cl.
CPC ..... *F01L 2101/00* (2013.01); *F01L 2250/06* (2013.01); *F01L 2810/02* (2013.01)

(58) Field of Classification Search
USPC ..... 123/90.17
See application file for complete search history.

(56) References Cited

OTHER PUBLICATIONS

Written Opinion (PCT/ISA/237) dated Mar. 18, 2014, by the Japanese Patent Office as the International Searching Authority for International Application No. PCT/JP2014/053482.

* cited by examiner

VALVE OPENING AND CLOSING TIMING CONTROL APPARATUS

TECHNICAL FIELD

This invention relates to a valve opening and closing timing control apparatus including a torsion coil spring which biases a driven-side rotational member integrally rotating with a camshaft of an internal combustion engine in an advanced angle direction or a retarded angle direction relative to a drive-side rotational member rotating synchronously with a crankshaft of the internal combustion engine.

BACKGROUND ART

In the aforementioned valve opening and closing timing control apparatus, an accommodation portion for accommodating the torsion coil spring is provided at a radially inner side of the driven-side rotational member. In a case where a relative rotational phase between the drive-side rotational member and the driven-side rotational member changes, a degree of torsion of the torsion coil spring changes within the accommodation portion, which changes outer diameter dimensions of the torsion coil spring. With the aforementioned configuration change, a portion of the torsion coil spring may slidably move relative to a bottom surface or an inner wall surface of the accommodation portion. In this case, an abrasion of a portion of the driven-side rotational member relative to which the coil spring slidably moves becomes a problem.

In order to address the aforementioned abrasion, according to a valve opening and closing timing control apparatus disclosed in Patent document 1, for example, a flower-shaped oil reservoir portion is provided at a contact surface of a driven-side rotational member making contact with a torsion coil spring so as to enhance a lubrication performance of the torsion coil spring. At this time, because oil includes foreign substances such as abrasion powders, for example, plural drain hole portions are provided at the oil reservoir portion so as to penetrate through the driven-side rotational member in an axial direction thereof. The oil is easily discharged via the drain hole portions when the valve opening and closing timing control apparatus is stopped to thereby remove the foreign substances.

In a valve opening and closing timing control apparatus disclosed in Patent document 2, a washer is arranged between a driven-side rotational member and a torsion coil spring in a rotation axis direction of the driven-side rotational member. The washer includes a guide portion obtained by cutting and lifting-up an outer edge portion to support the torsion coil spring from an inner side and a washer portion arranged between a surface of the torsion coil spring extending in a radial direction thereof and the bottom surface of the accommodation portion of the driven-side rotational member. Deformation of the torsion coil spring in the radial direction is restrained by the guide portion to thereby inhibit a contact between an outer peripheral portion of the torsion coil spring and an inner peripheral surface of the accommodation portion. In addition, the washer portion inhibits a contact between the torsion coil spring and the bottom surface of the accommodation portion of the driven-side rotational member. Because the torsion coil spring and the driven-side rotational member are configured so as not to directly make contact with each other, an abrasion of the driven-side rotational member in association with changes in outer diameter dimensions of the torsion coil spring is restrained.

DOCUMENT OF PRIOR ART

Patent Document

Patent document 1: JP2005-240651A
Patent document 2: JP2012-92739A

OVERVIEW OF INVENTION

Problem to be Solved by Invention

The valve opening and closing timing control apparatus disclosed in Patent document 1 is configured in a manner that the plural hole portions of the oil reservoir portion are in communication with a drain so that the oil is discharged to the drain when the valve opening and closing timing control apparatus is stopped. Thus, storability of oil decreases. In addition, because the plural hole portions provided at the oil reservoir portion are relatively large hole portions penetrating through the driven-side rotational member in the axial direction, strength of the driven-side rotational member decreases.

According to the valve opening and closing timing control apparatus disclosed in Patent document 2, an oil reservoir portion is provided using a void where the guide portion originally exists between a portion of the torsion coil spring supported by the guide portion which is provided at the washer in an extending manner and the bottom surface of the accommodation portion of the driven-side rotational member. At this time, though the inner side of the torsion coil spring is supported by the guide portion, a clearance may be generated between the torsion coil spring and the guide portion in a case where the outer diameter dimensions of the torsion coil spring change due to the change in degree of torsion. Thus, the oil at the aforementioned oil reservoir portion flows out through the clearance so that a performance of oil supply to the torsion coil spring may not be maintained.

The present invention is made in view of the drawback mentioned above and an object of the invention is to provide a valve opening and closing timing control apparatus including an oil reservoir portion which may effectively supply oil between a torsion coil spring and a driven-side rotational member.

Means for Solving Problem

A first characteristic construction of a valve opening and closing timing control apparatus according to the present invention includes a drive-side rotational member rotating synchronously with a crankshaft of an internal combustion engine, a driven-side rotational member integrally rotating with a camshaft of the internal combustion engine and rotating on a rotation axis same as a rotation axis of the drive-side rotational member, a phase control mechanism controlling to change a relative rotational phase between the drive-side rotational member and the driven-side rotational member, a torsion coil spring provided at an accommodation chamber which is defined by a front member provided at the drive-side rotational member and a tubular void provided at the driven-side rotational member in a state where the tubular void faces the front member, the torsion coil spring engaging with the front member and the driven-side rotational member to bias the driven-side rotational member in an advanced angle direction or a retarded angle direction relative to the driven-side rotational member, and an oil reservoir portion defined by an outer surface of the torsion coil spring facing the driven-side rotational member and at least one recess portion provided at the driven-side rotational member, the recess portion being provided in a radially outer direction from a position at a radially outer side than an inner diameter of the torsion coil spring and at a radially inner side than an outer diameter of the torsion coil spring.

According to the present construction, the oil reservoir portion is provided using a surface of a portion of the torsion coil spring to securely supply the oil to the torsion coil spring. In addition, the recess portion forming the oil reservoir portion is provided in the radially outer direction from the position at the radially outer side than the inner diameter of the torsion coil spring and at the radially inner side than the outer diameter of the torsion coil spring, so that the oil at the oil reservoir portion may be securely supplied to an outer circumferential side of the torsion coil spring. A sliding performance of the torsion coil spring increases to inhibit an abrasion of the driven-side rotational member and to increase durability thereof. Further, in a case where the internal combustion engine is stopped for a long time period, a state where the oil is adhered to the torsion coil spring is maintained. Thus, the sliding performance of the torsion coil spring for the next start is inhibited from being deteriorated to thereby smoothly perform a phase control between the drive-side rotational member and the driven-side rotational member.

Another characteristic construction of the valve opening and closing timing control apparatus according to the present invention is that the at least one recess portion includes a plurality of recess portions which are arranged along a circumferential direction of the driven-side rotational member.

According to the present construction, in a case where the plural recess portions are arranged along the circumferential direction, the oil may be stored in a dispersed manner at the oil reservoir portion. Specifically, because the oil is restricted to flow downward and is stored at an inner wall portion at the recess portion positioned at an upper side when the valve opening and closing timing control apparatus is stopped, an effect of oil supply to an entire circumference of the torsion coil spring may increase.

Still another characteristic construction of the valve opening and closing timing control apparatus according to the present invention is that a plate member is provided between the torsion coil spring and the driven-side rotational member, and the recess portion is defined by an outer edge portion of the plate member.

According to the present construction, the recess portion is defined by the outer edge portion of the plate member provided between the torsion coil spring and the driven-side rotational member. Thus, the oil reservoir portion including a depth corresponding to a thickness of the plate member may be easily provided.

Still another characteristic construction of the valve opening and closing timing control apparatus according to the present invention is that the driven-side rotational member is made of a ferrous material, and the oil reservoir portion is provided at a bottom surface of the accommodation chamber of the driven-side rotational member.

The driven-side rotational member is made of the ferrous material so that a degree of abrasion of the driven-side rotational member is small even when the driven-side rotational member directly makes contact with the torsion coil spring. Thus, in a case where the driven-side rotational member is formed of the ferrous material, the recess portion may be directly provided at the bottom surface of the accommodation chamber of the driven-side rotational member. Accordingly, the number of components is reduced and assembly hours decrease to thereby obtain the valve opening and closing timing control apparatus with a simple construction.

Still another characteristic construction of the valve opening and closing timing control apparatus according to the present invention is that an engagement portion engaging with one end portion of the torsion coil spring protrudes to a radially outer side from a peripheral wall surface of the accommodation chamber of the driven-side rotational member, the engagement portion being connected to the recess portion.

According to the present construction, the engagement portion engaging with one end portion of the torsion coil spring is provided so that the oil is also supplied to the end portion of the torsion coil spring to maintain lubrication with the driven-side rotational member. Accordingly, the abrasion of the driven-side rotational member may be reduced to inhibit a generation of frictional sound between the end portion of the torsion coil spring and the driven-side rotational member. Even in a case where a foreign substance is generated by the abrasion between the torsion coil spring and the driven-side rotational member, such foreign substance moves to the engagement portion by a centrifugal force, for example. As a result, a sliding movement between the torsion coil spring and the driven-side rotational member may be smoothly maintained.

MODE FOR CARRYING OUT THE INVENTION

Embodiments of the present invention are explained below with reference to drawings.

First Embodiment

FIGS. 1 to 5 each illustrate a valve opening and closing timing control apparatus of the present invention mounted at an engine (an example of an internal combustion engine) for an automobile.

[Entire Construction]

Figure 1:
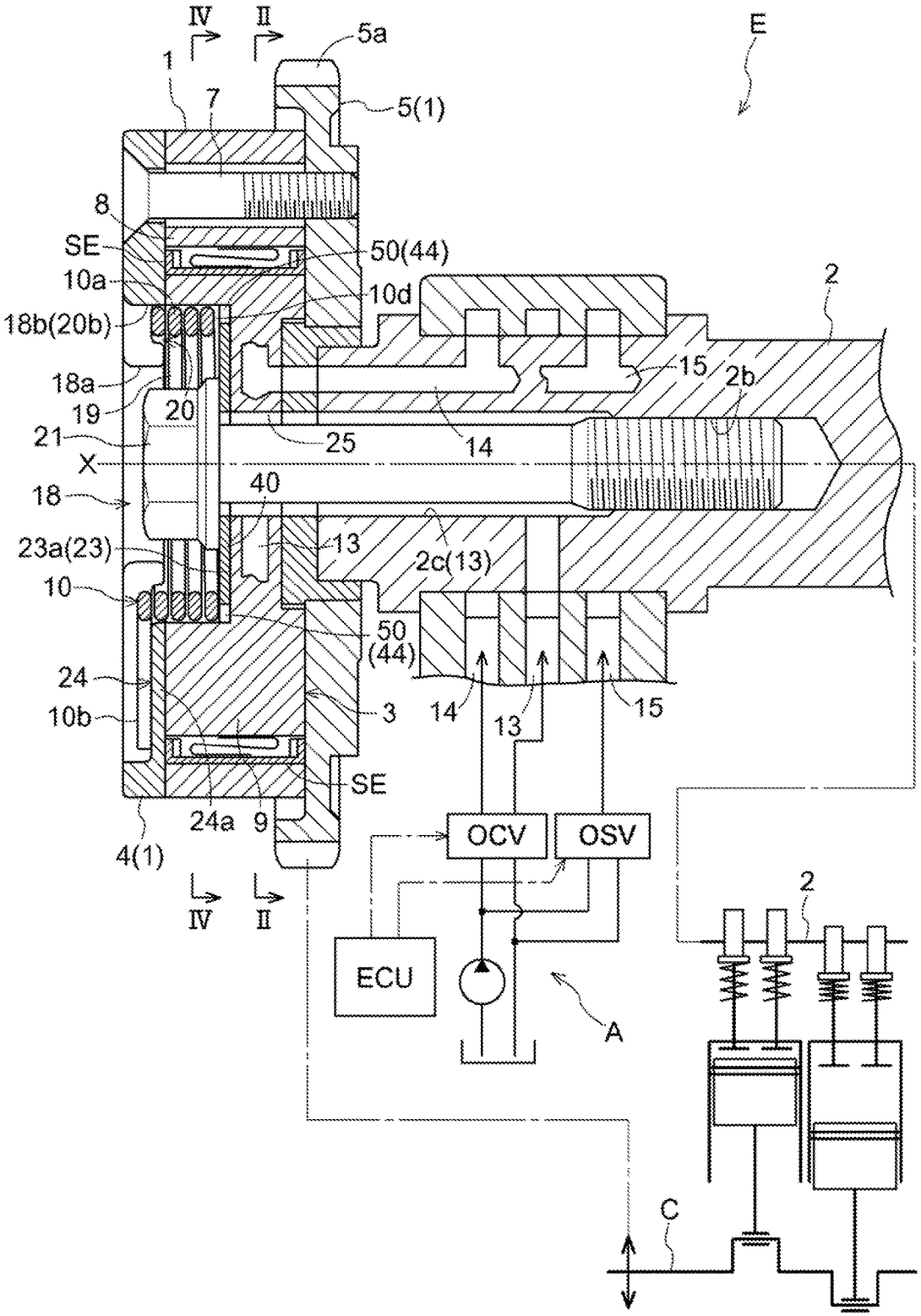
FIG. 1 is a longitudinal section view illustrating an entire construction of a valve opening and closing timing control apparatus.

As illustrated in FIG. 1, the valve opening and closing timing control apparatus includes an outer rotor 1 (an example of a drive-side rotational member), an inner rotor 3 (an example of a driven-side rotational member), a torsion coil spring 10 and a phase control mechanism A. The outer rotor 1 rotates synchronously with a crankshaft C of an engine E. The inner rotor 3, which is made of aluminum alloy, rotates integrally with a camshaft 2 of the engine E. The torsion coil spring 10 biases the inner rotor 3 in an advanced angle direction (in a direction of an arrow S1 in FIG. 2) relative to the outer rotor 1. The phase control mechanism A changes and controls a relative rotational phase between the outer rotor 1 and the inner rotor 3. The outer rotor 1 and the inner rotor 3 rotate on the same axis X.

[Outer Rotor and Inner Rotor]

As illustrated in FIGS. 1 to 4, the outer rotor 1 includes a front plate (an example of a front member) 4 and a rear plate 5 provided at a side where the camshaft 2 is arranged. In the outer rotor 1, the front plate 4 and the rear plate 5 are fixed in a state being fastened together by four flat countersunk head screws 7. A sprocket 5*a* is provided at an outer circumferential portion of the rear plate 5 to receive power from the crankshaft C.

The torsion coil spring 10 is disposed at an accommodation chamber 23 defined by the front plate 4 and a tubular void which is provided at the inner rotor 3 in a state facing the front plate 4. The torsion coil spring 10 engages with the front plate 4 and the inner rotor 3 in a state being torsionally deformed in a diameter reduction direction. The torsion coil spring 10 biases the inner rotor 3 in the advanced angle direction or a retarded angle direction relative to the outer rotor 1.

Figure 2:
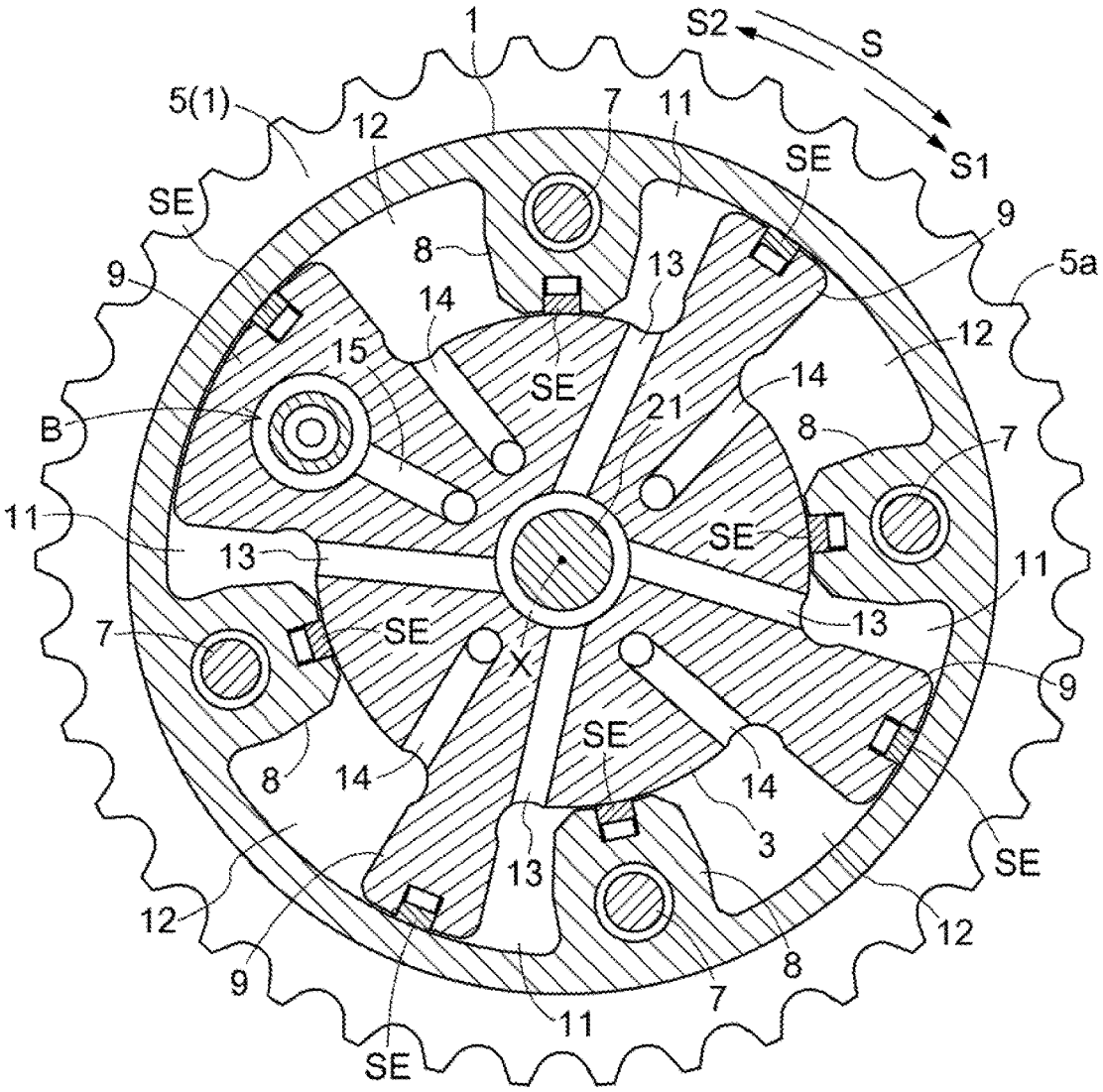
FIG. 2 is a cross-sectional view taken along a line II-II in FIG. 1.

In a case where the crankshaft C is driven to rotate, a rotation driving force is transmitted to the rear plate 5 via a power transmission member such as a chain, for example, so that the outer rotor 1 rotates in a direction illustrated by an arrow S in FIG. 2. In conjunction with the rotation drive of the outer rotor 1, the inner rotor 3 is driven to rotate in a rotation direction S via oil within advanced angle chambers 11 and retarded angle chambers 12 to thereby rotate the camshaft 2. Then, cams (not illustrated) provided at the camshaft 2 operate intake valves of the engine E.

Plural first partition portions 8 protruding inward in a radial direction are provided at an inner circumferential portion of the outer rotor 1. Plural second partition portions 9 protruding outward in the radial direction are provided at an outer circumferential portion of the inner rotor 3. A void between the outer rotor 1 and the inner rotor 3 is divided by the first partition portions 8 into plural hydraulic chambers. Each of the plural hydraulic chambers is divided by each of the second partition portions 9 into the advanced angle chamber 11 and the retarded angle chamber 12. Seal members SE are provided at a position of the first partition portion 8 facing an outer peripheral surface of the inner rotor 3 and at a position of the second partition portion 9 facing an inner peripheral surface of the outer rotor 1.

As illustrated in FIGS. 1 and 2, the phase control mechanism A supplies the oil to the advanced angle chambers 11 and the retarded angle chambers 12, discharges the oil from the advanced angle chambers 11 and the retarded angle chambers 12 and interrupts the supply and discharge of the oil relative to the advanced angle chambers 11 and the retarded angle chambers 12 so as to change and controls the relative rotational phase between the outer rotor 1 and the inner rotor 3. Advanced angle passages 13 connecting the respective advanced angle chambers 11 to the phase control mechanism A, retarded angle passages 14 connecting the respective retarded angle chambers 12 to the phase control mechanism A and a lock passage 15 connecting a lock mechanism B to the phase control mechanism A are provided at inner portions of the camshaft 2 and the inner rotor 3. The lock mechanism B locks the inner rotor 3 and the outer rotor 1 at a predetermined relative rotational phase.

The phase control mechanism A includes an oil pan, an oil pump, a fluid control valve OCV, a fluid switching valve OSV and an electronic control unit ECU controlling operations of the fluid control valve OCV and the fluid switching valve OSV. Because of a control operation by the phase control mechanism A, the inner rotor 3 is displaced in the advanced angle direction (in the direction illustrated by the arrow S1 in FIG. 1) or the retarded angle direction (in a direction illustrated by an arrow S2 in FIG. 1) relative to the outer rotor 1 to hold the relative rotational phase between the inner rotor 3 and the outer rotor 1 at an arbitral phase.

The inner rotor 3 and the camshaft 2 are fastened and fixed by a bolt 21. The bolt 21 is fastened to an internally threaded portion 2*b* provided at a back side of an insertion bore 2*c* provided at a tip end portion of the camshaft 2. Accordingly, the inner rotor 3 is integrally fixed to the tip end portion of the camshaft 2. A penetration bore 25 through which the bolt 21 penetrates is provided at the inner rotor 3. A head portion of the bolt 21 is held within the accommodation chamber 23. A clearance defined by the penetration bore 25 of the inner rotor 3, the insertion bore 2*c* of the camshaft 2 and the bolt 21 functions as the advanced angle passage 13.

[Oil Reservoir Portion]

Figure 3:
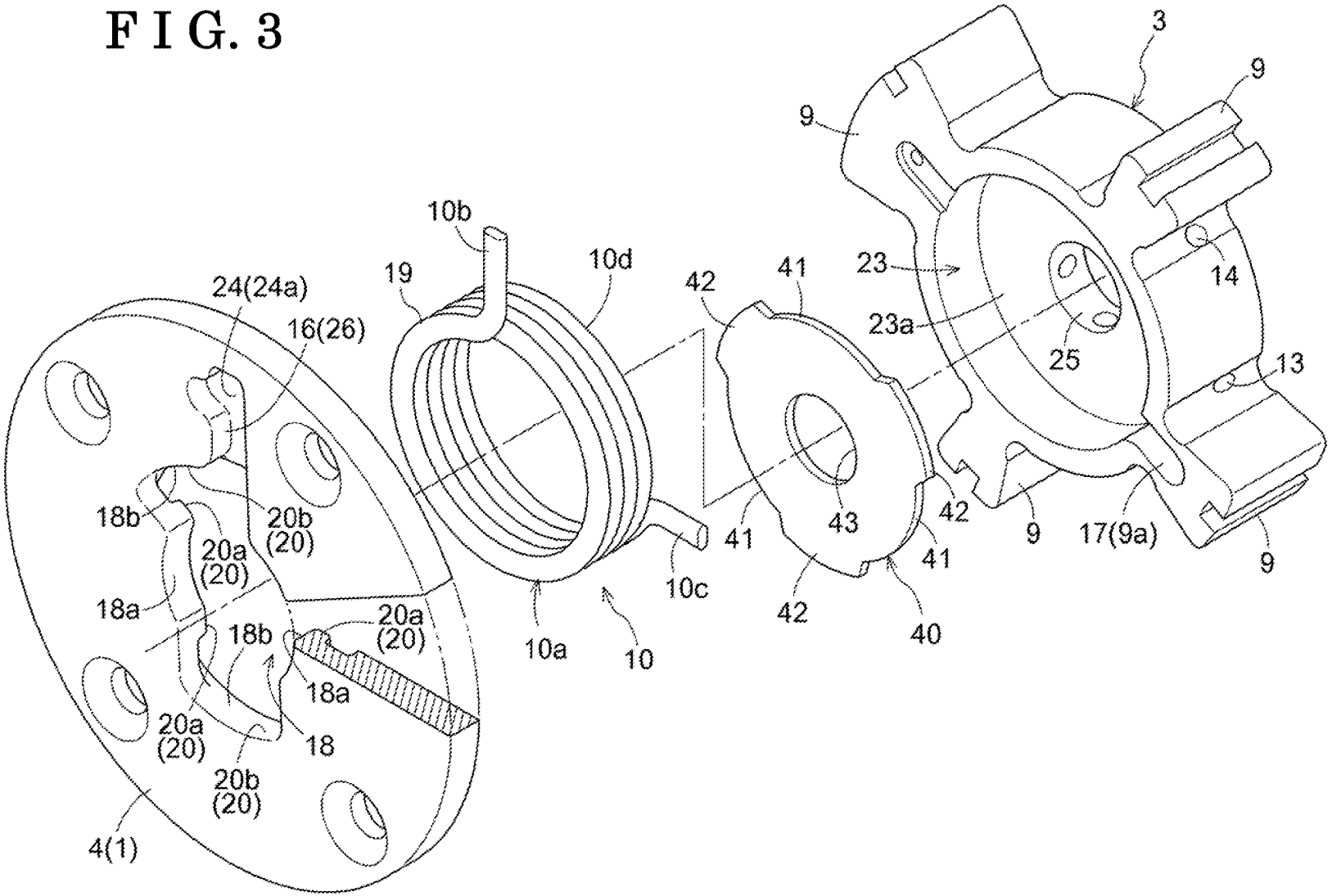
FIG. 3 is an exploded perspective view of the valve opening and closing timing control apparatus.
Figure 4:
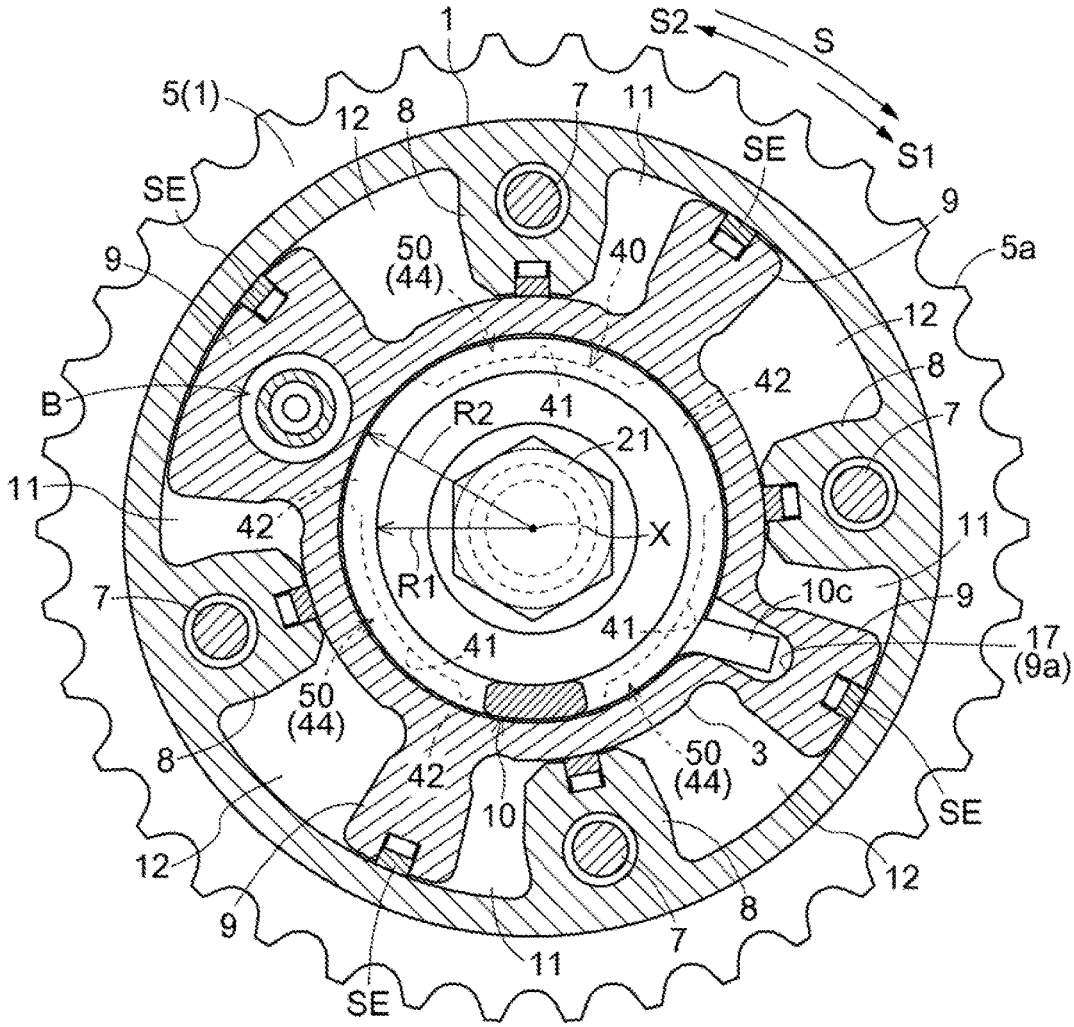
FIG. 4 is a cross-sectional view taken along a line IV-IV in FIG. 1.
Figure 5:
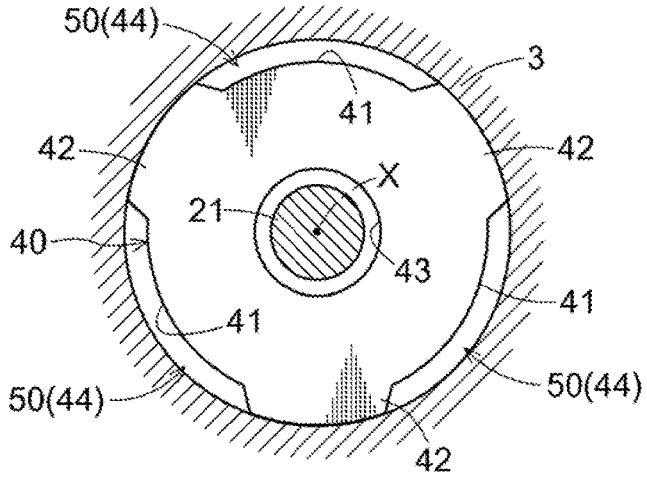
FIG. 5 is a cross-sectional view of a main portion illustrating a plate member and an oil reservoir portion of the valve opening and closing timing control apparatus.

A plate member 40 is arranged between the torsion coil spring 10 and a bottom surface 23*a* of the accommodation chamber 23 of the inner rotor 3. The plate member 40 is made of steel, for example, so that the plate member 40 is unlikely to be worn away by a sliding contact with the torsion coil spring 10. The plate member 40 includes a circular configuration along an outer circumference of the accommodation chamber 23. As illustrated in FIGS. 3 to 5, the plate member 40 includes plural cut portions 41 and protruding portions 42 (in the drawings, three cut portions 41 and three protruding portions 42) which are alternately arranged at an outer edge. A bore portion 43 for the bolt 21 is provided at a center of the plate member 40. The cut portions 41 (outer edge portion of the plate member 40) and the bottom surface 23*a* of the accommodation chamber 23 achieve recess portions 44. An oil reservoir portion 50 is defined by an end surface (outer surface) 10*d* of the torsion coil spring 10 facing the bottom surface 23*a* and at least one of the recess portions 44 provided at the inner rotor 3.

Accordingly, the oil reservoir portion 50 is provided using a surface of a portion of the torsion coil spring 10 to securely supply the oil to the torsion coil spring 10. A sliding performance of the torsion coil spring 10 increases to inhibit an abrasion of the inner rotor 3 and to increase durability thereof. In addition, in a case where the engine E is stopped for a long time period, a state where the oil is adhered to the torsion coil spring 10 is maintained. Thus, the sliding performance of the torsion coil spring 10 for the next start is inhibited from being deteriorated to thereby smoothly perform a phase control between the outer rotor 1 and the inner rotor 3.

As illustrated in FIG. 4, each of the recess portions 44 is provided in a radially outer direction from a position at a radially outer side than an inner circumferential portion (inner diameter R1) of the torsion coil spring 10 and at a radially inner side than an outer circumferential portion (outer diameter R2) of the torsion coil spring 10. Accordingly, the oil stored at the oil reservoir portion 50 may be easily adhered to the outer surface of the torsion coil spring 10 so that the oil supply to the torsion coil spring 10 may be securely performed.

The plural recess portions 44 are arranged along a circumferential direction of the inner rotor 3 to thereby store the oil in a dispersed manner at the oil reservoir portion 50. Specifically, because the oil is stored at the recess portion 44 positioned at an upper side when the valve opening and closing timing control apparatus is stopped, an effect of oil supply to the torsion coil spring 10 may increase.

[Assembly Structure of Torsion Coil Spring]

As illustrated in FIGS. 1 and 4, the torsion coil spring 10 includes a front-side spring end portion 10*b* and a rotor-side spring end portion 10*c* at end portions of a spring body 10*a* wound in a coil form. The front-side spring end portion 10*b* engages with a front-side engagement portion 16 provided at the front plate 4 while the rotor-side spring end portion 10*c* engages with a rotor-side engagement portion 17 provided at the inner rotor 3. Each of the front-side spring end portion 10*b* and the rotor-side spring end portion 10*c* is arranged to protrude outward in a radial direction of the spring body 10*a*.

As illustrated in FIG. 3, the front plate 4 includes a different diameter penetration bore 18. The different diameter penetration bore 18 includes two inner arc portions 18*a* and two outer arc portions 18*b* which are alternately arranged in the circumferential direction. The inner arc portions 18*a* include the same diameters as each other and the outer arc portions 18*b* include the same diameters as each other. Each of the inner arc portions 18*a* is coaxial with the axis X and is configured to include a diameter greater than an outer diameter of the head portion of the bolt 21 and smaller than an inner diameter of a winding portion 19 of the spring body 10*a*. Each of the outer arc portions 18*b* is coaxial with the axis X and is configured to include a diameter substantially the same as an inner diameter of the accommodation chamber 23 of the inner rotor 3.

Holding portions 20 supporting an outer circumferential side of the winding portion 19 over an entire circumference thereof are provided at a rear surface (inner surface side) of the front plate 4. The holding portions 20 are arranged along the two inner arc portions 18*a* and the two outer arc portions 18*b* respectively. The holding portions 20 include first holding portions 20*a* arranged along the inner arc portions 18*a* and second holding portions 20*b* arranged along the outer arc portions 18*b*. A surface of the holding portion 20 in contact with the spring body 10*a* is formed in a spiral manner including an inclination along a pitch of the spring body 10*a* which is torsionally deformed.

The first holding portions 20*a* support an inner circumferential side of the winding portion 19 and the second holding portions 20*b* support an outer circumferential side of the winding portion 19. The winding portion 19 positioned at the outer arc portions 18*b* is exposed to a front surface side of the front plate 4 via the different diameter penetration bores 18. Accordingly, the inner circumferential side and the outer circumferential side of the torsion coil spring 10 are supported by the first holding portions 20*a* and the second holding portions 20*b* so that an axial position of the torsion coil spring 10 substantially matches the rotation axis X of the inner rotor 3.

One of the two outer arc portions 18*b* is provided with the front-side engagement portion 16 engaging with the front-side spring end portion 10*b*. The front-side engagement portion 16 engages with the front-side spring end portion 10*b* from a circumferential direction of the coil spring in a state where the torsion of the torsion coil spring 10 is obtained.

In the front-side engagement portion 16, a recess surface portion 24 in communication with one of the outer arc portions 18*b* is provided at the front surface side of the front plate 4 so that an engagement surface portion 26 with which the front-side spring end portion 10*b* makes contact from the circumferential direction of the coil spring for engagement is provided at the recess surface portion 24. Accordingly, the front-side spring end portion 10*b* is engageable with a bottom surface portion 24*a* of the recess surface portion 24 from the rear surface side of the front plate 4.

The rotor-side engagement portion 17 is constituted by a groove portion 9*a* provided at one of the plural second partition portions 9 provided at the inner rotor 3. The groove portion 9*a* is provided to protrude outward in the radial direction from a peripheral wall surface of the accommodation chamber 23 and to be connected to the recess portion 44.

Because the rotor-side engagement portion 17 is provided, the oil is also supplied to the rotor-side spring end portion 10*c* of the torsion coil spring 10 to thereby maintain lubrication with the inner rotor 3. Accordingly, the abrasion of the inner rotor 3 may be reduced to inhibit a generation of frictional sound between the rotor-side spring end portion 10*c* of the torsion coil spring 10 and the inner rotor 3, for example. Even in a case where a foreign substance is generated by the abrasion between the torsion coil spring 10 and the inner rotor 3, for example, such foreign substance moves to the rotor-side engagement portion 17 by a centrifugal force, for example. As a result, a sliding movement between the torsion coil spring 10 and the inner rotor 3 may be smoothly maintained.

A torsional force of the torsion coil spring 10 where the rotor-side spring end portion 10*c* engages with the rotor-side engagement portion 17 is received by the front plate 4 with which the front-side spring end portion 10*b* engages. Accordingly, the torsion coil spring 10 biases the inner rotor 3 in the advanced angle direction relative to the outer rotor 1.

Figure 6:
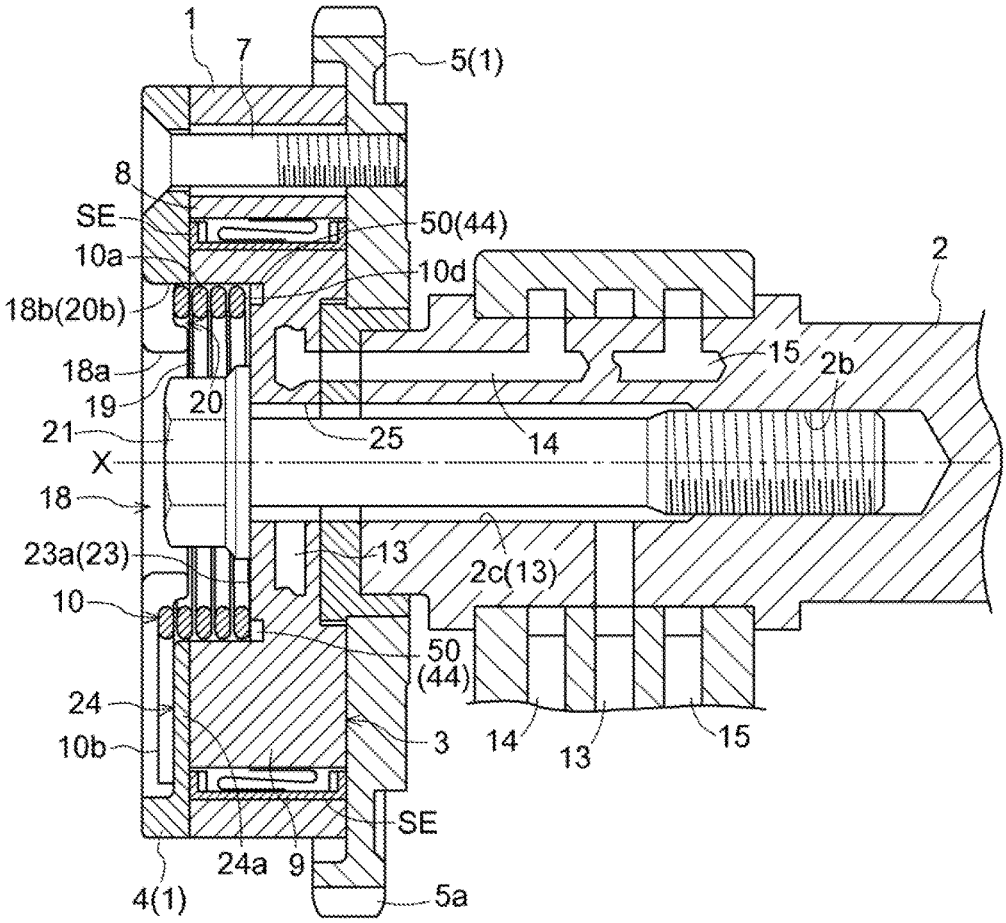
FIG. 6 is a longitudinal section view illustrating an entire construction of the valve opening and closing timing control apparatus according to another embodiment.
Figure 7:
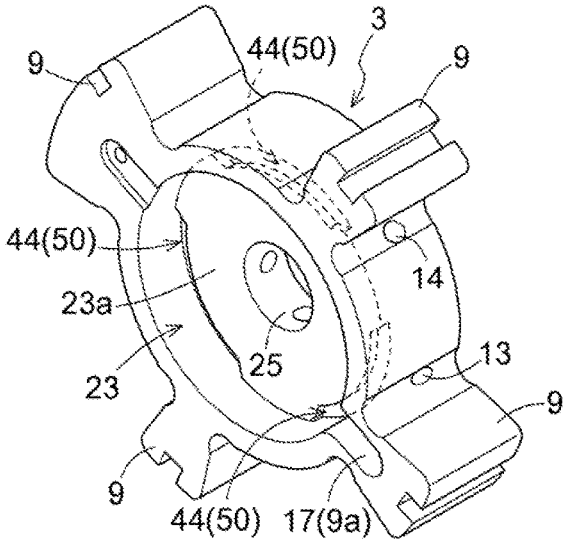
FIG. 7 is a perspective view of a driven-side rotational member according to another embodiment.

Another Embodiment (1) The inner rotor 3 may be made of a ferrous material. In this case, a degree of abrasion of the inner rotor 3 caused by the contact with the torsion coil spring 10 decreases. In a case where the inner rotor 3 is made of the ferrous material, the recess portion 44 may be directly provided at the bottom surface 23*a* of the accommodation chamber 23 of the inner rotor 3 as illustrated in FIGS. 6 and 7. Accordingly, the number of components is reduced and assembly hours decrease to thereby obtain the valve opening and closing timing control apparatus with a simple construction.

The recess portion 44 may be provided over the entire circumference of the bottom surface 23*a* of the accommodation chamber 23. Alternatively, as illustrated in FIG. 7, the plural recess portions 44 may be provided in arc forms at the bottom surface 23*a* of the accommodation chamber 23. According to the recess portions 44 which are arranged dispersedly along the circumferential direction, while the effect of oil supply relative to the torsion coil spring 10 is maintained, the recess portions 44 provided at the inner rotor 3 may be downsized as much as possible. A strength decrease of the inner rotor 3 may be kept to a minimum.

(2) The recess portion 44 may be a bore portion provided at the plate member 40 or the bottom surface 23*a* of the accommodation chamber 23 to be disposed at a position at an inner side of the outer diameter of the torsion coil spring 10 and at an outer side than the inner diameter of the torsion coil spring 10.

(3) In the aforementioned embodiment, an example where the rotor-side engagement portion 17 is provided outward in the radial direction. Alternatively, the rotor-side engagement portion 17 may be provided along a rotation axis direction. The front-side engagement portion 16 may be also provided at the rear surface (inner surface side) of the front plate 4. As a result, the oil pushed out from the advanced angle chamber 11 or the retarded angle chamber 12 is supplied to the front-side spring end portion 10*b* of the torsion coil spring 10 to decrease a sliding resistance or a sliding sound at the rear surface (inner surface side) of the front plate 4.

INDUSTRIAL AVAILABILITY

The present invention is applicable to a valve opening and closing timing control apparatus for an internal combustion engine of an automobile and other applications.

EXPLANATION OF REFERENCE NUMERALS

1 drive-side rotational member (outer rotor)
2 camshaft
3 driven-side rotational member (inner rotor)
4 front member (front plate)
10 torsion coil spring
10*b* front-side spring end portion
10*c* rotor-side spring end portion
10*d* end surface
16 front-side engagement portion
17 rotor-side engagement portion
23 accommodation chamber
23*a* bottom surface
40 plate member
44 recess portion
50 oil reservoir portion
A phase control mechanism
E internal combustion engine
R1 inner diameter of torsion coil spring
R2 outer diameter of torsion coil spring
X rotation axis

The invention claimed is:

1. A valve opening and closing timing control apparatus comprising:

a drive-side rotational member rotating synchronously with a crankshaft of an internal combustion engine;

a driven-side rotational member integrally rotating with a camshaft of the internal combustion engine and rotating on a rotation axis same as a rotation axis of the drive-side rotational member;

a phase control mechanism controlling to change a relative rotational phase between the drive-side rotational member and the driven-side rotational member;

a torsion coil spring provided at an accommodation chamber which is defined by a front member provided at the drive-side rotational member and a tubular void provided at the driven-side rotational member in a state where the tubular void faces the front member, the torsion coil spring engaging with the front member and the driven-side rotational member to bias the driven-side rotational member in an advanced angle direction or a retarded angle direction relative to the driven-side rotational member; and an oil reservoir portion defined by an outer surface of the torsion coil spring facing the driven-side rotational member and at least one recess portion provided at the driven-side rotational member, the recess portion being provided in a radially outer direction from a position at a radially outer side than an inner diameter of the torsion coil spring and at a radially inner side than an outer diameter of the torsion coil spring.

2. The valve opening and closing timing control apparatus according to claim 1, wherein the at least one recess portion includes a plurality of recess portions which are arranged along a circumferential direction of the driven-side rotational member.

3. The valve opening and closing timing control apparatus according to claim 1, wherein a plate member is provided between the torsion coil spring and the driven-side rotational member, and the recess portion is defined by an outer edge portion of the plate member.

4. The valve opening and closing timing control apparatus according to claim 1, wherein the driven-side rotational member is made of a ferrous material, and the oil reservoir portion is provided at a bottom surface of the accommodation chamber of the driven-side rotational member.

5. The valve opening and closing timing control apparatus according to claim 1, wherein an engagement portion engaging with one end portion of the torsion coil spring protrudes to a radially outer side from a peripheral wall surface of the accommodation chamber of the driven-side rotational member, the engagement portion being connected to the recess portion.

* * * * *